US005632428A

United States Patent [19]

Weiss

[11] Patent Number: 5,632,428

[45] Date of Patent: May 27, 1997

[54] RESTRAINING DEVICE

[76] Inventor: Fred R. Weiss, 627 N. Brainard Ave., LaGrange Park, Ill. 60525

[21] Appl. No.: 635,675

[22] Filed: Apr. 22, 1996

Related U.S. Application Data

[63] Continuation-in-part of Ser. No. 448,039, May 23, 1995, abandoned.

[51] Int. Cl.[6] ..... A45F 3/04

[52] U.S. Cl. ..... 224/623; 224/646; 224/648; 224/654; 224/660; 224/672; 224/250; 224/908

[58] Field of Search ..... 224/250, 251, 224/262, 623, 645, 646, 648, 650, 654, 660, 662, 665, 671, 672, 675, 908, 910

[56] References Cited

U.S. PATENT DOCUMENTS 4,168,022 9/1979 Brewer .
4,232,808 11/1980 Gray ..... 224/908
4,320,863 3/1982 Lyer et al. .
4,349,139 9/1982 Oishi .
4,396,137 8/1983 Benjamin .
4,416,405 11/1983 Caillouet .
4,461,411 7/1984 Harrow .
5,277,347 1/1994 Savard ..... 224/250

*Primary Examiner*—Henry J. Recla
*Assistant Examiner*—Timothy L. Maust
*Attorney, Agent, or Firm*—Juettner Pyle Lloyd & Piontek

[57] ABSTRACT

A restraining strap includes a waistband for circumferentially transversing the waist of the user having thereon a yoke. The yoke comprises a first length and a second length when extended from the waistband, where each of the first and second lengths has a proximal end fixedly attached to different locations on the waistband. A distal end of each of the first and second lengths are attached one to the other at or near each of the distal ends of the first and second lengths. Restrainers are positioned proximate the distal end to form a holder therebetween. The article may be enclosed by the holder such that the restraining maintains the suspended article from motion relative the user.

30 Claims, 5 Drawing Sheets

RESTRAINING DEVICE

This application is a continuation-in-part of application Ser. No. 08/448,039 filed on May 23, 1995, now abandoned.

FIELD OF THE INVENTION

The present invention relates to a restraining strap for an article suspended by a neck-strap placed about a neck of a user. More particularly, the present invention is directed to a restraining strap having a yoke for attachment to a suspended article, such as a camera, to prevent lateral and vertical motion and maintain the article near the body of the user.

BACKGROUND OF THE INVENTION

Neck-straps for carrying various items, such as cameras and binoculars, have existed for many years. However, one frequent drawback to the use of such neck-straps is undesired motion of the article relative the user's body. This undesired motion takes several forms, such as bouncing, swinging or swaying, and is especially pronounced when the user is in motion, such as during brisk walking, biking or running, or traversing a difficult path, such as during hiking or rock climbing. Such motion can also disrupt the user's balance, which can be dangerous. Even when sedentary, user's tend to assume positions and postures which allow the article to dangle and become a nuisance, such as while reclining or bending over to tie one's shoes. Avoiding such undesired motion by maintaining a grip on the article with one's hand prevents keeping both hands free for other tasks.

Not only is such undesired motion uncomfortable, distracting and awkward, it can also lead to damage of the article worn about the user's neck. For example, a swaying camera worn about a user's neck can strike nearby objects, such as the handlebars of a bicycle, rock formations while hiking, or chairs when tying one's shoes. Such impacts can lead to significant and costly damage to expensive and delicate articles like cameras and binoculars. Such impacts can also cause damage to other objects, such as glass windows.

At the same time, however, it is generally considered necessary and helpful to have such suspended articles instantly and conveniently available for their intended use.

SUMMARY OF THE INVENTION

In accordance with the foregoing drawbacks associated with the neck-straps of the prior art, it is an object of the present invention to provide a restraining strap that will automatically maintain an article suspended by a neck-strap proximate the user's body.

It is a further object of the present invention to provide a restraining strap that can be quickly attached and detached from an article suspended by a neck-strap.

It is another object of the present invention to provide a restraining strap that can be used over all garments and in all environments.

It is yet another object of the present invention to provide a restraining strap that allows instantaneous use of the article as intended, while otherwise preventing the article from undesirable motion.

It is a further object of the present invention to provide a restraining strap that can be easily stored in a user's pocket when not in use.

It is still a further object of the present invention to provide a restraining strap that uses a loop for maintaining the article to prevent undesirable motion, and adjustability for securing the loop to the article.

It is yet another object of the present invention to provide a restraining strap that can be simply and quickly adjusted to correspond to the height at which the article is usually suspended when the article's neck-strap is used.

It is still another object of the present invention to provide a restraining strap that can be simply and quickly adjusted to correspond to an article even if the article is contained within a protective case.

These and additional objects of the present invention may be determined from a review of the instant disclosure, wherein there is disclosed a restraining strap for an article suspended by a neck-strap placed about a neck of a user to prevent an article from motion relative the user.

The restraining strap includes an adjustable waistband circumferentially transversing the waist of the user. Attached to the waistband is a yoke. The yoke, preferably constructed of a continuous loop of relatively thin, flexible webbing, comprises a first length and a second length when extended from the waistband. Each of the first and second lengths has a proximal end attached to different locations on the waistband. Each of the first and second lengths also has a distal end, the first and second lengths being attached one to the other at or proximate each of the distal ends of the first and second lengths. In the preferred embodiment of the present invention, the continuous loop is inherently so attached at the distal end.

A holding means is located proximate the distal ends of the first and second lengths and is adapted for receiving the suspended article and for preventing the suspended article from motion relative the user. Preferably, there is provided restraining means including spring-loaded "O" clamps positioned between the proximal and distal ends of both the first and second lengths and about the same. Each of the clamps are slidable along both the loop lengths to define the holding means such that when finally positioned proximate the article and placing the first and second lengths in tension, the clamps restrain therebetween the suspended article from motion relative the user. The clamps are easily adjusted and securely attached to the loop by a knot tied in the extreme distal end of the lengths forming the loop.

As a particularly advantageous feature of the present invention, the suspended article can be immediately and completed separated from the restraining strap, so that use of the article can be readily shared with another person, or when the user simply prefers to carry the article without the restraining strap. In this latter case, the restraining strap can be conveniently carried in a user's pocket or purse.

Other objects, advantages and features of the invention will become apparent upon a consideration of the following detailed description, when taken in conjunction with the accompanying drawings.

DETAILED DESCRIPTION OF THE INVENTION

Figure 1:
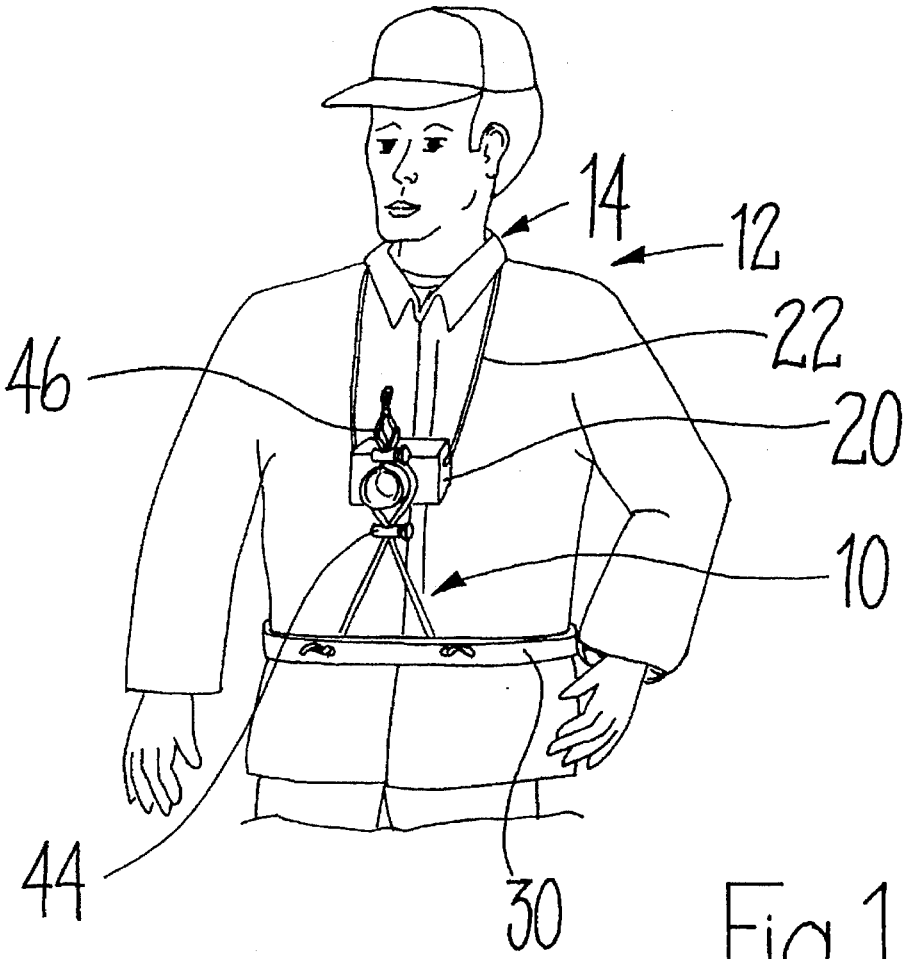
FIG. 1 is an overall view of a first embodiment of the restraining strap of the present invention as used by a user.

There is illustrated in the accompanying drawings the article having a neck-strap used in combination with and the restraining strap of the present invention. As shown in FIG. 1, a first embodiment of the restraining strap 10 of the present invention is shown as used by a user 12. An article 20, shown here as a camera, is suspended about the neck 14 of the user 12 by a neck-strap 22. It is contemplated that the article could be a camera, binoculars or such other similarly suspended article. Ordinarily, the neck-strap 22 is sufficient to suspend the article 20 against the force of gravity. However, to prevent the aforementioned disadvantages of merely using the neck-strap 22, the restraining strap 10 of the present invention is shown attached to the article 20.

Figure 2:
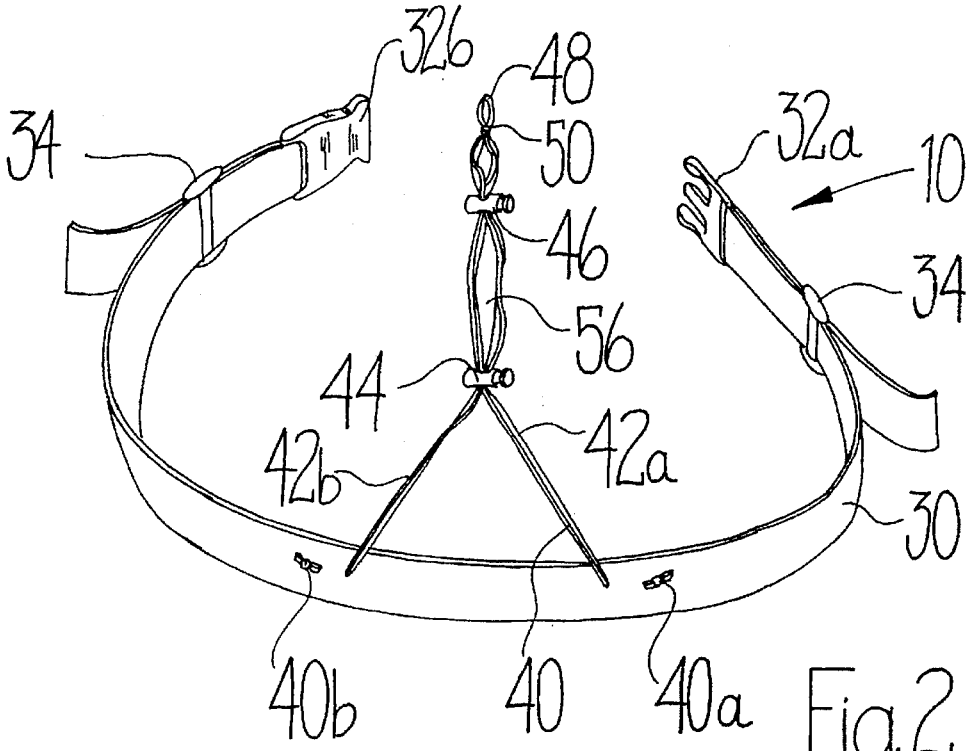
FIG. 2 is a perspective view of the first embodiment of the restraining strap of the present invention.
Figure 4A:
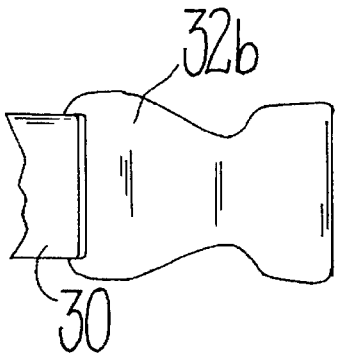
FIG. 4*a* is a plan view of the detached clasping means of the present invention.
Figure 4B:
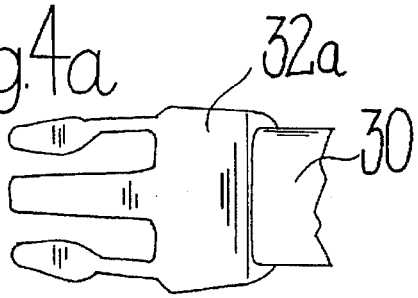
FIG. 4*b* is a plan view of the attached clasping means of the present invention.
Figure 4B:
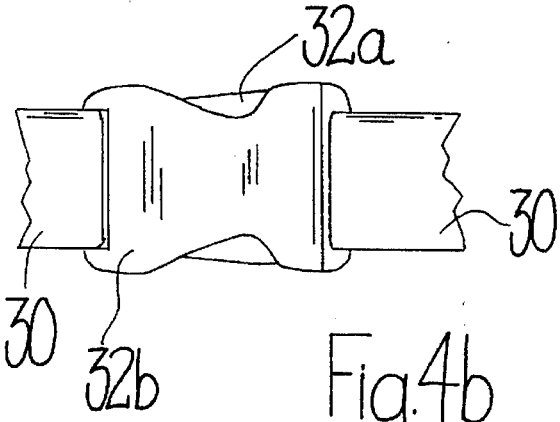

As better seen in FIG. 2, the first embodiment of the restraining strap 10 of the present invention includes an adjustable waistband 30, preferably made of flexible heavy weight polypropylene webbing (0.060 inch by 1.00 inch). The lengths of the waistband 30 preferably should be of sufficient length to extend about a multitude of user waistlines and over heavy clothing. At a first end of the waistband 30 is a male clasping member **32*a* and at the other end is a female clasping member 32*b*, as better shown in FIGS. 4*a* and 4*b***.

Figure 5:
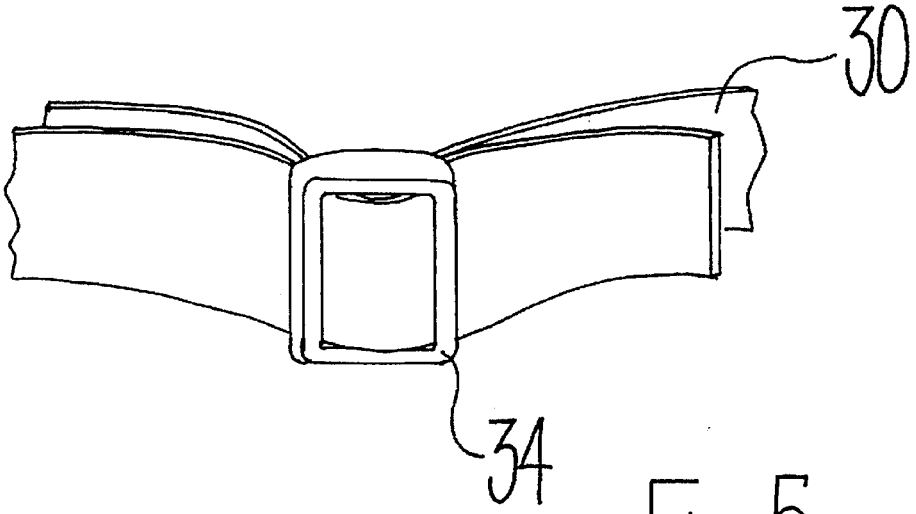
FIG. 5 is a perspective view of the waistband adjusting means of the present invention.

The clasping members **32*a*, 32*b*, preferably those designated Model No. TSR 100 and manufactured by I.T.W., Nexus of Wooddale, Ill., are attached to the waistband, and the waistband length can be adjusted, through adjustment clamps 34 (better shown in FIG. 5) located at either end of the waistband 30. The adjustment clamps 34 are preferably a standard Tri-Glide™ clamp manufactured by I.T.W., Nexus in Wooddale, Ill. The ends of waistband 30 are respectively threaded through one of the clamps 34 and through either of the clasping member 32*a*, 32*b*, which are provided with a post as is commonly known, and then re-threaded through one of the clamps 34. Although the overall length of the waistband 30 can be adjusted, tension on the clamps 34 tends to tighten the waistband 30 therethrough and cinches tight the waistband 30** for a snug fit.

Attached to the waistband 30 worn about the waist of the user 12 is a loop 40 forming a yoke assembly. Loop 40 is also preferably made of a flexible webbing manufactured by Mitchellace, although of a width substantially thinner than that of the waistband 30. The loop 40 also could be made of a thick cord. A first proximal end **40*a* of the loop 40 is passed through a small hole in the waistband 30 and again passed through a second small hole in the waistband 30, after which it is secured therein, such as through a secure knot, such that the proximal end 40*a* cannot pass back through the waistband 30. The other proximal end 40*b* of the loop 40 is similarly secured to the waistband 30. The result of the construction is to form two lengths 42*a*, 42*b* of the yoke assembly, wherein a distal end 48 forms an apex of a triangle, with the first length 42*a* and the second length 42*b* as the sides of the triangle and the waistband 30** as the base of the triangle. Such geometry uniquely provides a maintaining force against lateral and vertical motion of the object, while also holding the article against the user's torso.

Figure 3:
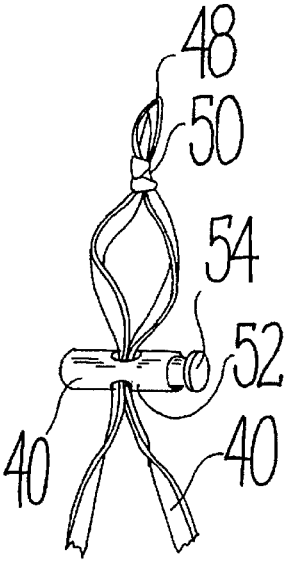
FIG. 3 is a plan view of a restraining means of the first embodiment of the restraining strap of the present invention.

Two identical lower and upper restraining means 44, 46 (upper restraining means 46 being better shown in FIG. 3) are slid over the distal end 48 of the loop 40. Preferably, the restraining means 44, 46 are Ellipse Cord Closures™ or clamps manufactured by I.T.W., Nexus from Wooddale, Ill. Once slid over the loop 40, the restraining means 44, 46 are retained thereon by a barrier means, preferably again a secure knot 50. As can be seen in FIG. 3, the restraining means 46 (and similarly restraining means 44) has an orifice 52 through which the loop 40 is slid. A spring-loaded plunger 54 which, when depressed, releases a locking means allows the restraining means 44,46 to slide upon the loop 40, as is shown.

In operation, the waistband is applied by the user 12 through the clasping means **32*a*, 32*b* and adjusted for a snug fit through adjustment clamps 34. Once positioned, the article 20 is inserted into an holding means or opening 56 formed in the loop 40 between the restraining means 44, 46. The lower restraining means 44 is slid up or down, depending on the length of neck-strap 22 suspending the article 20, so that it is placed proximate to and below the article 20 with no slack in lengths 42*a*, 42*b*. The restraining means 46 can then be brought in proximately to and above the article 20 until snug. Thus, the article 20 is held in close proximity to the torso of the user 12 and is unable to swing, sway or strike other objects. To free the article 20 for immediate use, the restraining means 46** can be immediately released and raised and the article then released.

Alternatively, the dedicated waistband 30 of the present invention can be replaced by an existing waistband such as those used with "fanny packs" or waistpacks. As further discussed herein, other attachment means, such as a clip or a loop, can be provided at the proximal ends **40*a*, 40*b* of the loop 40 for attachment of the loop 40 to the existing waistband. This detachable attachment means can replace the holes in the waistband 30 and the knots in the loop 40 therethrough. So attached to the waistband, the loop and the structure of the invention otherwise remain the same. If the article is within a protective carrying case, it is envisioned that protrusions, such as buttons, can be attached thereto to provide a more convenient "looping" point for attachment of the loop 40 through the holding means 56**.

Figure 6:
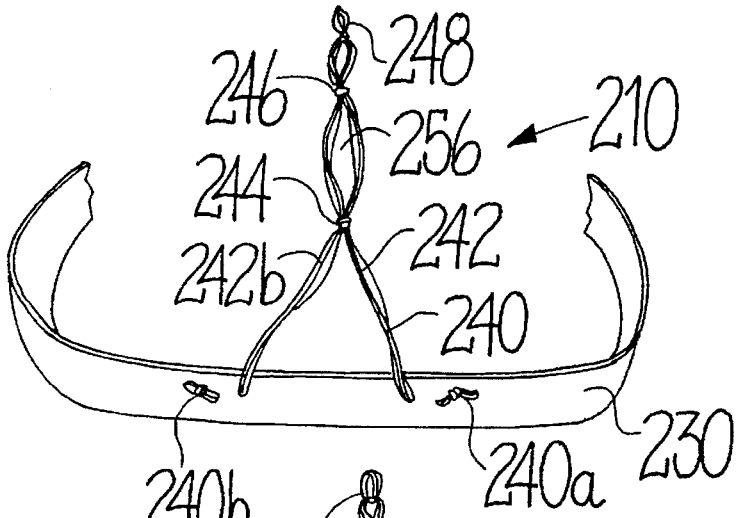
FIG. 6 is a perspective view of a second embodiment of the restraining strap of the present invention.

Shown in FIG. 6 is a second embodiment of the restraining strap 210 of the present invention which includes an adjustable waistband 230 as described above for waistband 30. The male and female clasping members corresponding to members **32*a* and 32*b*** and the adjustment means described above have been omitted from the view, but are essentially the same as that noted above.

Attached to the waistband 230 is a flexible webbing 240 forming a yoke assembly. Flexible webbing 240 is made of an elastomeric webbing material or an elastomeric cord. The flexible webbing 240 can be a single continuous loop having a knot 246 as discussed above or alternatively two separate segments tied at a knot 246 at a distal end 248. A first proximal end 240*a* of the flexible webbing 240 is passed through a small hole in the waistband 230 and again passed through a second small hole in the waistband 230, after which it is secured therein through a secure knot. The other proximal end 240*b* of the flexible webbing 240 is similarly secured to another location on the waistband 230. A knot 244 is located between the proximate ends 240*a*, 240*b* and the knot 246. The result of the construction is to form two lengths 242*a*, 242*b* of the yoke assembly, wherein the knot 244 forms an apex of a triangle, with the first length 242*a* and the second length 242*b* as the sides of the triangle and the waistband 230 as the base of the triangle. Again, the unique geometry of the present invention provides a maintaining force against lateral and vertical motion of the object, while holding the article against the user's torso.

In operation, with the waistband 230 worn, the article 20 is inserted into a holding means or opening 256 formed between the restraining means or knots 244, 246 by stretching the flexible webbing 240 between the restraining means 244, 246 until the opening 256 is of sufficient size to accept the article 20. When released, the flexible webbing 240 between the restraining means 244, 246 will return to its original length and thereby hold the article 20 in close proximity to the torso of the user 12 and prevent the article 20 from swinging, swaying or striking other objects. To free the article 20 for immediate use, the flexible webbing 240 between the restraining means 244, 246 is again stretched until the opening 256 is of sufficient size to release the article 20. It should be noted that either or both of the knots 244, 246 can be replaced with clamps similar to the restraining means 44, 46 described above.

Figure 7:
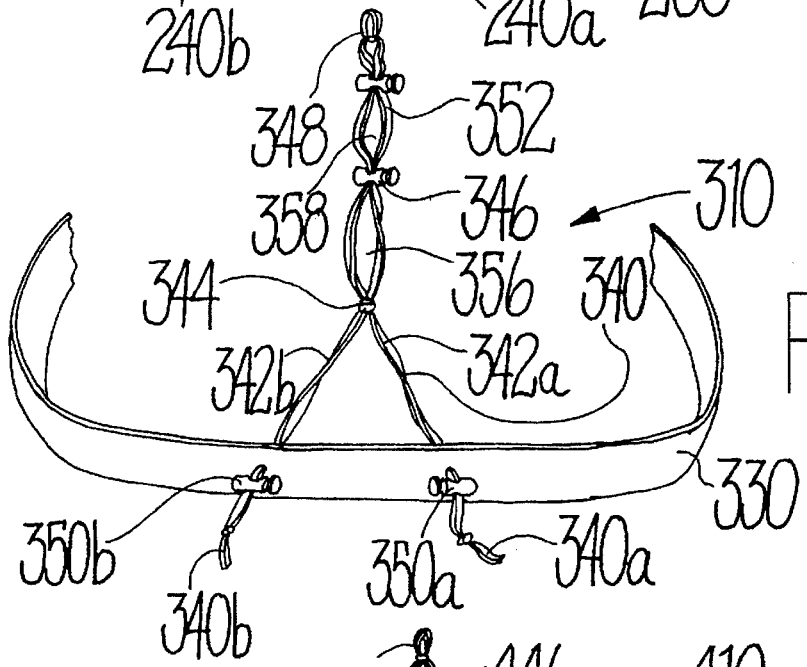
FIG. 7 is a perspective view of a third embodiment of the restraining strap of the present invention.

A third embodiment is shown in FIG. 7, wherein the restraining strap 310 of the present invention includes a similar waistband 330. Attached to the waistband 330 is a flexible webbing 340 similarly forming a yoke assembly. Flexible webbing 340 is preferably made of a non-elastomeric flexible webbing manufactured by Mitchellace or of a thick cord. The flexible webbing 340 can be a single continuous loop or two separate segments secured together at a distal end 248. A first proximal end 340*a* of the flexible webbing 340 is passed through a small hole in the waistband 330 and an adjustable clamp 350*a* is slid over the proximate end 240*a* of the flexible webbing 340, such that the proximal end 340*a* cannot pass back through the waistband 330. The clamp 350*a* may be similar to the restraining means 44, 46 described above. The other proximal end 340*b* of the flexible webbing 340 is similarly secured to the waistband 330 via clamp 350*b*. This construction likewise forms two lengths 342*a*, 342*b* of the yoke assembly, wherein a knot 344 (or, alternatively, a clamp similar to restraining means 44, 46) forms an apex of a triangle, with the first length 342*a* and the second length 342*b* as the sides of the triangle and the waistband 330 as the base of the triangle to form the geometry uniquely maintaining force against lateral and vertical motion of the object, while also holding the article against the user's torso.

With the waistband 330 positioned, the article 20 can be inserted into a holding means or opening 356 formed in the flexible webbing 340 between the knot 344 and a restraining means 346 comprising a clamp as previously described. It is also possible to reverse the knot 344 and the restraining means 346, such that the knot 344 is replaced by the clamp and the clamp 346 is replaced by a knot. Additionally, above the restraining means 346, a second restraining means or clamp 352 can be provided so as to form a second holding means or opening 358 for accepting a second article for restraint. The restraining means 346 and 352 can then be brought in proximately to and above the first and/or second article 20 until snug. Thus, the articles may be held in close proximity to the torso of the user 12 and unable to swing, sway or strike other objects. Release of articles is as described above.

Figure 8:
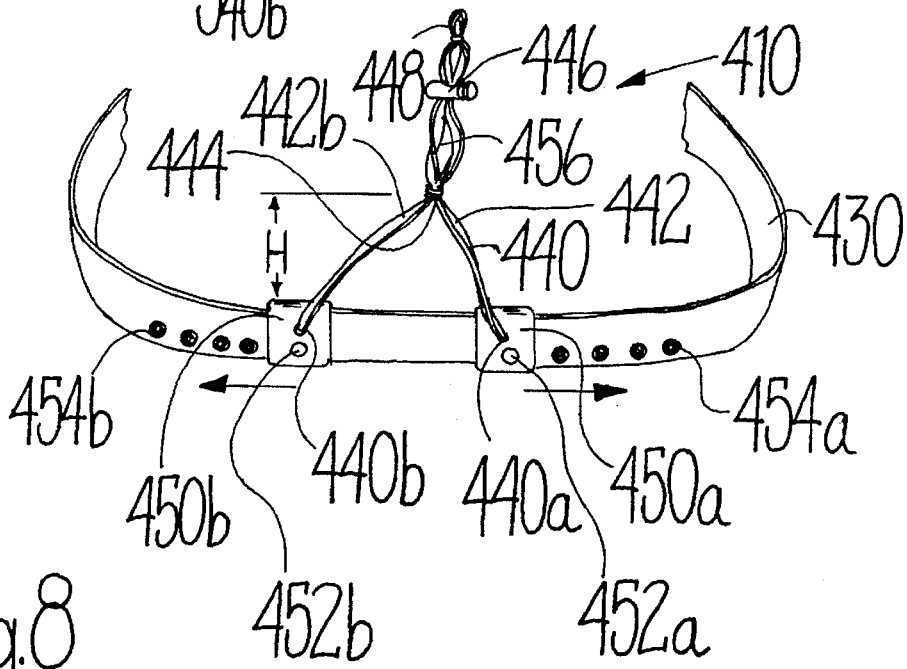
FIG. 8 is a perspective view of a fourth embodiment of the restraining strap of the present invention.

A fourth embodiment can be seen in FIG. 8, where the restraining strap 410 of the present invention includes an adjustable waistband 430 as described above. Attached to the waistband 430 is a flexible webbing 440 as described above for the third embodiment, omitting the second opening 358. A first proximal end 440*a* of the flexible webbing 440 is attached to a collar 450*a* which is slidable along the length of the waistband 430. The collar 450*a* is provided with a female snap member 452*a*, which may be detachably connected to any of a series of male snap members 454*a* to restrain the collar 450*a* and the proximal end 440*a* in position. The snap members 452*a* and 454*a* can be replaced with hooks or buttons. The other proximal end 440*b* of the flexible webbing 440 is similarly secured to the waistband 430. The construction forms two lengths 442*a*, 442*b* of the yoke assembly, wherein a knot 444 (which also forms a lower restraining means) forms an apex of a triangle, with the first length 442*a* and the second length 442*b* forming the sides of the triangle and the waistband 430 as the base of the triangle to create the unique geometry of the present invention.

An upper restraining means 446 as described above is slid over the distal end 448 of the flexible webbing 440. The article 20 is inserted into a holding means or opening 456 formed in the flexible webbing 440 between the restraining means 444, 446. As the lower restraining means 444 is stationary, the restraining means 446 may be moved up or down, depending on the length of neck-strap 22 suspending the article 20, so that the opening 456 is placed about the article 20. To remove slack from the lengths 442*a*, 442*b*, the collars 450*a*, 450*b* can be moved apart and reattached to the waistband 430, thus adjusting the height H of the article 20 above the waistband 430. Thus, the article 20 is held in close proximity to the torso of the user 12 and is unable to swing, sway or strike other objects.

Figure 9:
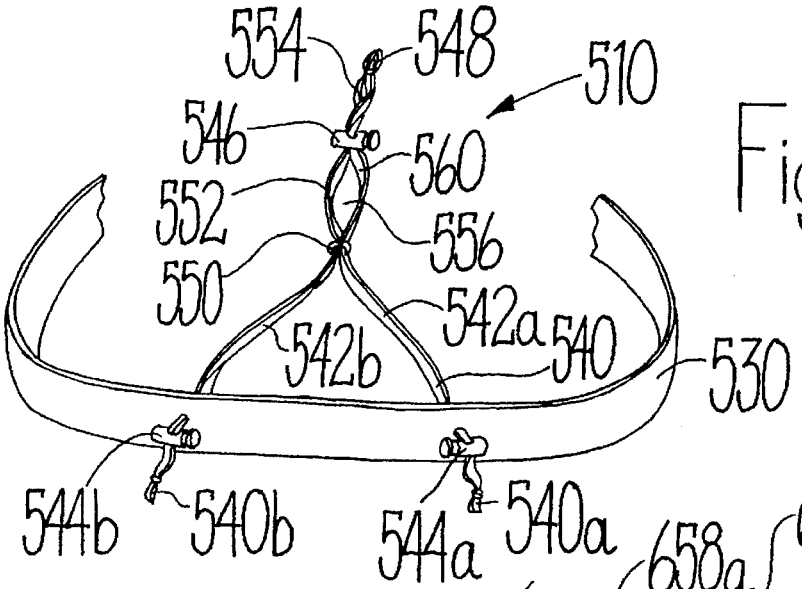
FIG. 9 is a perspective view of a fifth embodiment of the restraining strap of the present invention.

As shown in FIG. 9, a fifth embodiment of the restraining strap 510 of the present invention includes a similar waistband 530 and an attached flexible webbing 540 forming a yoke assembly. Flexible webbing 540 is also preferably made of a flexible webbing manufactured by Mitchellace. A first proximal end 540*a* of the loop 540 is passed through a small hole in the waistband 530 and an adjustable clamp 544*a* is slid over the proximate end 540*a* of the flexible webbing 540, such that the proximal end 540*a* cannot pass back through the waistband 530. The flexible webbing 540 also passes through a ring (or other similar attaching device) 550, which as described below forms a lower restraining means. An upper flexible webbing 552 is likewise passed through the ring 550. The result of the construction is to form two lengths 542*a*, 542*b* of the yoke assembly, wherein the ring 550 forms an apex of a triangle, with the first length 542*a* and the second length 542*b* as the sides of the triangle and the waistband 530 as the base of the triangle.

An upper restraining means 546 (the upper restraining means 546 being better shown in FIG. 3) is slid over a distal end 548 of the upper flexible webbing 552. Once slid over the upper flexible webbing 552, the restraining means 546 is likewise retained by a barrier means, preferably again a secure knot 554. The article 20 is inserted into a holding means or opening 556 formed in the upper flexible webbing 552 between the restraining means 544, 546. The upper restraining means 546 is slid up or down, depending on the length of neck-strap 22 suspending the article 20, so that it is placed proximate to the article 20. Slack is removed from the lengths 542*a*, 542*b* by adjusting the clamps 544*a*, 544*b* until snug. Thus, the article 20 is held in close proximity to the torso of the user 12 and is unable to swing, sway or strike other objects.

Figure 11:
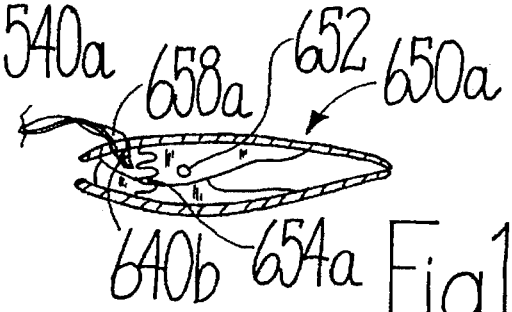
FIG. 11 is an sectional view of a clip comprising a portion of the means for attaching the proximal ends of the first and second lengths of the sixth embodiment of the restraining strap of the present invention to the waistband.
Figure 10:
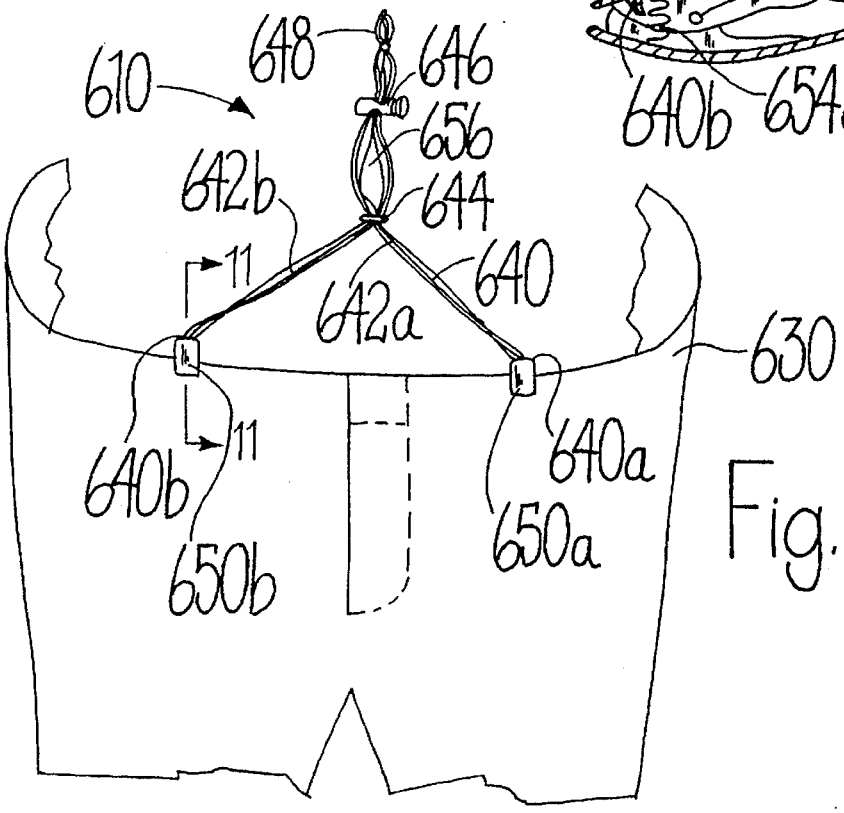
FIG. 10 is a perspective view of a sixth embodiment of the restraining strap of the present invention.

Shown in FIG. 10 is a sixth embodiment of the restraining strap 610 of the present invention for combination with a waistband 630 of a pair of trousers or a separate belt. The flexible webbing 640 is similar to that described in the fourth embodiment above. However, a first proximal end 640*a* of the loop 640 is passed through a small hole 658*a* in a clip 650*a* (better shown in FIG. 11 ). The clip 650*a* is urged to a closed position by a spring 654*a* and pivots into an open position about a pivot pin 652*a*. The clip 650*a* can thus be attached to the waistband 630 at different locations to change the height of the lower restraining means 646 relative the waistband 640. The article 20 may be inserted into a holding means or opening 556 formed in the flexible webbing 640 between the restraining means 644, 646. The upper restraining means 646 is adjusted as described above.

Figure 12:
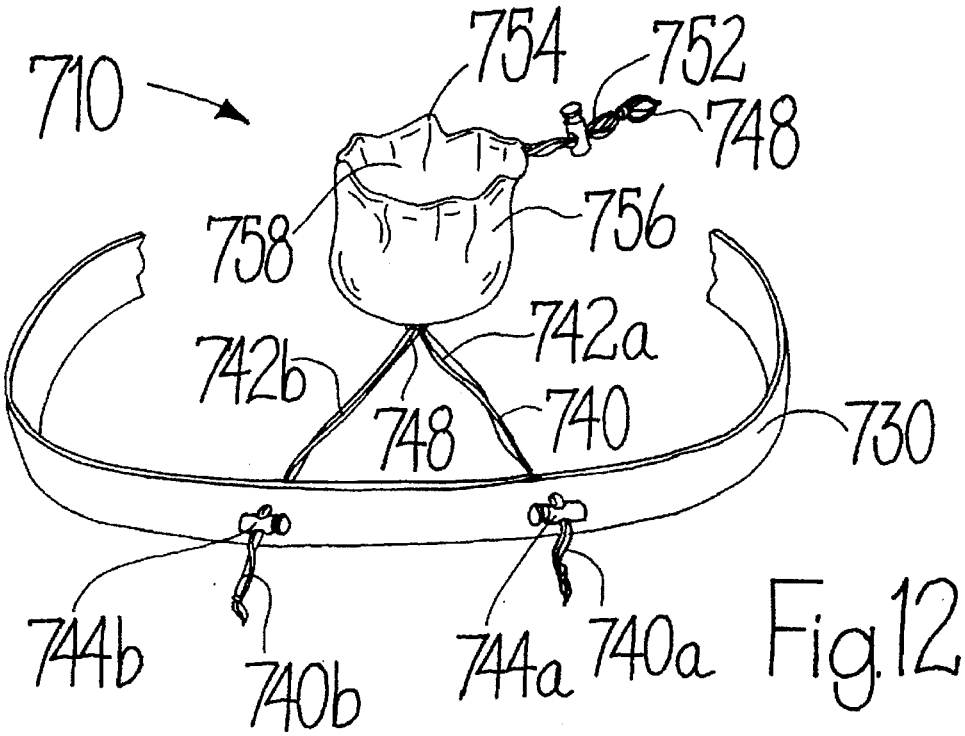
FIG. 12 is a perspective view of a seventh embodiment of the restraining strap of the present invention.

A seventh embodiment is shown in FIG. 12. Here, however, the lower restraining means 748 forming the apex of the triangle is attached to a holding means or pouch 756, wherein the article 20 may be placed for protection against the elements. A drawstring 754 encircles an opening 758 of the pouch 756, where once the drawstring 754 is drawn tight about the article 20, an upper restraining means 752 or clamp positioned proximate a distal end 748 of the restraint 710 maintains the article 20 in position.

Figure 13:
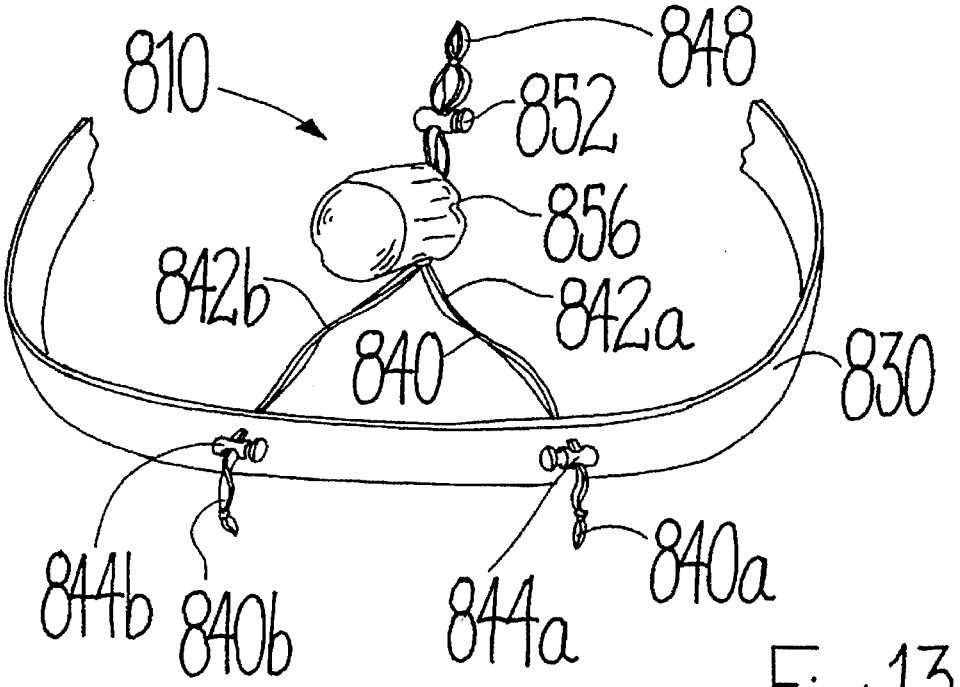
FIG. 13 is a perspective view of an eighth embodiment of the restraining strap of the present invention.

An eighth embodiment is shown in FIG. 13 and is similar to the seventh embodiment. However, here, the holding means or pouch 856 does not entirely receive the article 20, but rather a portion of the article 20 (such as a lens). Thus, for large or bulky items needing protection of sensitive optics and the like only, such limited protection can be accomplished according to the present invention.

While various embodiments of the invention have been described in detail, various modifications and other embodiments thereof may be devised by one skilled in the art without departing from the spirit and scope of the invention, as defined by the appended claims.

I claim:

1. A restraining strap for an article suspended by a neck-strap placed about a neck of a user, the restraining strap comprising:

a detachable waistband of adjustable length for circumferentially transversing a waist of the user;

a yoke having a first length and a second length, each of the first and second lengths further having a proximal end and a distal end, the proximal end of each of the first and second lengths being attached to different locations on the waistband and the first and second lengths attached one to the other at or proximate the distal ends of the first and second lengths; and a lower and upper restraining means, each restraining means being positioned between the proximal and distal ends of both the first and second lengths and each of the restraining means being adapted for slidable motion along both the first and second lengths for restraining therebetween the suspended article from motion relative the user.

2. The restraining strap of claim 1, wherein the distal ends form an apex of a triangle with the first and second lengths as the sides of the triangle and the waistband as the base of the triangle.

3. The restraining strap of claim 1, wherein the restraining means are positioned about each of the first and second lengths.

4. The restraining strap of claim 3, wherein each of the first and second restraining means further comprise a clamp having a body with an orifice for passage therethrough of the first and second lengths, a releasable plunger and a biasing means for urging the plunger toward the body and maintaining each of the restraining means in a fixed position relative each of the first and second lengths and biasing means.

5. The restraining strap of claim 1, wherein the restraining means are retained to the restraining strap by a barrier means located at or near the distal end of the first and second lengths.

6. The restraining strap of claim 1, wherein the restraining means are retained to the restraining strap by a knot tied at or near the distal end of the first and second lengths.

7. The restraining strap of claim 1, wherein the first and second lengths are formed from a flexible webbing.

8. The restraining strap of claim 7, wherein the upper and lower restraining means are retained about the loop by a knot tied at the extreme distal end of both the first and second lengths.

9. The restraining strap of claim 1, wherein the proximal ends of the first and second lengths are provided with detachable attachment means for attaching the proximal ends of the first and second lengths to the waistband.

10. A restraining strap for an article suspended by a neck-strap placed about a neck of a user, the restraining strap comprising:

a waistband for circumferentially transversing a waist of the user; and a yoke comprised of a flexible webbing having a first end and a second end; and a pair of restraining means, the first end and second end of the flexible webbing being attached to different locations on the waistband such that when the flexible webbing is extended from the waistband, the flexible webbing forms a triangle defined by a first and second half of the flexible webbing as the sides of the triangle and the waistband as the base of the triangle, a lower and an upper restraining means being positioned between an apex of the triangle and waistband, each of the restraining means being adapted for slidable motion along both the first and second halves of the flexible webbing for restraining therebetween the suspended article from motion relative the user.

11. The restraining strap of claim 10, wherein a barrier means at or near the apex of the triangle retains the restraining means about the loop.

12. The restraining strap of claim 11 wherein the barrier means is a tied knot.

13. In combination with an article suspended by a neck-strap placed about a neck of a user and a detachable waistband adapted for circumferentially transversing a waist of the user, a restraining strap comprising:

a yoke having a first length and a second length, each of the first and second lengths further having a proximal end and a distal end, the proximal end of each of the first and second lengths being adapted for attachment to different locations on the waistband and the first and second lengths attached one to the other at or near each of the distal ends of the first and second lengths; and a first and a second restraining means, each restraining means being positioned between the proximal and distal ends of both the first and second lengths and each of the restraining means being adapted for slidable motion along both the first and second lengths for restraining therebetween the suspended article from motion relative the user.

14. The restraining strap of claim 13, wherein the restraining means are positioned about each of the first and second lengths.

15. The restraining strap of claim 14, wherein each of the first and second restraining means further comprise a clamp having a body with an orifice for passage therethrough of the first and second lengths, a releasable plunger and a biasing means for urging the plunger toward the body and maintaining the clamp into a fixed position relative each of the first and second lengths and biasing means.

16. The restraining strap of claim 13, wherein the restraining means are retained to the restraining strap by a barrier means located at or near the distal end of the first and second lengths.

17. The restraining strap of claim 13, wherein the restraining means are retained to the restraining strap by a knot tied at or near the distal end of the first and second lengths.

18. The restraining strap of claim 13, wherein the first and second lengths are formed of a flexible webbing.

19. The restraining strap of claim 18, wherein the first and second restraining means are retained about the flexible webbing by a knot tied at the extreme distal end of both the first and second lengths.

20. In combination with an article suspended by a neck-strap placed about a neck of a user and a waistband adapted for circumferentially transversing a waist of the user, a restraining strap comprising:

flexible webbing having a first length and a second length, each of the first and second lengths further having a proximal end and a distal end, the proximal end of each of the first and second lengths being attached to different locations on the waistband and the first and second lengths secured one to the other at or proximate each of the distal ends of the first and second lengths;

holding means proximate the distal ends of the first and second lengths, the holding means being adapted for receiving the suspended article; and means for restraining the suspended article from motion relative the user.

21. The combination of claim 20, wherein the proximal end of the first and second lengths are provided with attachment means for attaching the proximal ends of the first and second lengths to the waistband.

22. The combination of claim 20, wherein the first and second lengths are attached one to the other at a first and second location, each location being proximate the distal end of the first and second lengths and the first location being secured with an adjustable clamp such that the holding means is defined by a loop between the clamp and the second location.

23. The combination of claim 22 wherein the first location is closer to the proximate ends of the first and second lengths than the second location.

24. The combination of claim 22 wherein the second location is closer to the proximate ends of the first and second lengths than the first location.

25. The combination of claim 22 wherein the attachment of the proximate ends of the first and second lengths to the waistband further includes adjustment means for allowing selective attachment to a plurality of the locations to the waistband.

26. The combination of claim 20 wherein the holding means further comprises a pouch having an opening, the pouch adapted for attachment to the distal end of the first and second lengths and the restraining means further comprising a drawstring and clamp situated about the opening of the pouch.

27. The combination of claim 20, wherein the first and second lengths are attached one to the other at a first and second location, each location being proximate the distal end of the first and second lengths, and the restraining means further comprising adjustable clamping means disposed at the proximate ends of the first and second lengths to the waistband.

28. The combination of claim 20, wherein the first and second lengths are attached one to the other at a first and second location, each location being proximate the distal end of the first and second lengths, and the restraining means further comprising an elastomeric first and second member.

29. In combination with an article suspended by a neck-strap placed about a neck of a user and a waistband adapted for circumferentially transversing a waist of the user, a restraining strap comprising:

a yoke having a first length and a second length, each of the first and second lengths further having a proximal end and a distal end, the proximal end of each of the first and second lengths being attached to different locations on the waistband and the first and second lengths secured one to the other at or near each of the distal ends of the first and second lengths;

a lower and upper restraining means, each of the upper and lower restraining means being positioned between the proximal and distal ends of both the first and second lengths to define a holding means; and adjustment means adapted for restraining the suspended article within the holding means from motion relative the user.

30. A restraining strap for an article suspended by a neck-strap placed about a neck of a user, the restraining strap comprising:

a waistband adapted for circumferentially transversing a waist of the user;

a yoke of flexible webbing having a first length and a second length, each of the first and second lengths further having a proximal end and a distal end, the proximal end of each of the first and second lengths being attached to different locations on the waistband and the first and second lengths secured one to the other at or proximate each of the distal ends of the first and second lengths;

holding means proximate the distal ends of the first and second lengths, the holding means being adapted for receiving the suspended article; and means for restraining the suspended article within the holding means from motion relative the user.

* * * * *